US009350101B2

(12) United States Patent
Taylor

(10) Patent No.: US 9,350,101 B2
(45) Date of Patent: May 24, 2016

(54) MALE BLADE ELECTRICAL CONNECTOR

(71) Applicant: Pancon Corporation LLC, East Taunton, MA (US)

(72) Inventor: Robert Taylor, Coventry, RI (US)

(73) Assignee: Pancon Corporation LLC, East Taunton, MA (US)

( * ) Notice: Subject to any disclaimer, the term of this patent is extended or adjusted under 35 U.S.C. 154(b) by 0 days.

(21) Appl. No.: 14/278,149

(22) Filed: May 15, 2014

(65) Prior Publication Data

US 2015/0333426 A1 Nov. 19, 2015

(51) Int. Cl.

| | |
|---|---|
| ***H01R 13/40*** | (2006.01) |
| ***H01R 12/58*** | (2011.01) |
| ***H01R 13/04*** | (2006.01) |
| ***H01R 43/16*** | (2006.01) |
| *H01R 9/28* | (2006.01) |
| *H01R 24/28* | (2011.01) |

(52) U.S. Cl.
CPC ..... *H01R 13/04* (2013.01); *H01R 43/16* (2013.01); *Y10T 29/49206* (2015.01)

(58) Field of Classification Search
CPC ..... H01R 12/585; H01R 13/40; H01R 12/58; H01R 9/28; H01R 24/28
USPC ..... 439/82, 751, 83, 947
See application file for complete search history.

(56) References Cited

U.S. PATENT DOCUMENTS

| | | | | |
|---|---|---|---|---|
| 4,752,250 | A * | 6/1988 | Seidler | 439/751 |
| 5,556,308 | A * | 9/1996 | Brown et al. | 439/746 |
| 6,338,632 | B1 * | 1/2002 | Jones | 439/82 |
| 6,702,595 | B2 * | 3/2004 | Nelson et al. | 439/83 |
| 8,840,408 | B2 * | 9/2014 | Baba et al. | 439/83 |
| 8,888,541 | B2 * | 11/2014 | Endo et al. | 439/751 |
| 8,968,010 | B2 * | 3/2015 | Endo et al. | 439/82 |
| 2003/0124886 | A1 * | 7/2003 | Reisdorf et al. | 439/82 |
| 2013/0244506 | A1 * | 9/2013 | Endo | H01R 4/48 439/825 |
| 2013/0244512 | A1 * | 9/2013 | Endo | H01R 12/585 439/889 |

OTHER PUBLICATIONS

Application Specification, Tyco Electronics Company, a TE Connective Ltd. Company, "FASTON 110, 187, 205, 250 and 312 Series Tab Contacts for Printed Circuit (PC) Board Applications,", Apr. 20, 2011 (14 pages).

* cited by examiner

*Primary Examiner* — Amy Cohen Johnson
*Assistant Examiner* — Matthew T Dzierzynski
(74) *Attorney, Agent, or Firm* — Occhiuti & Rohlicek LLP

(57) ABSTRACT

An electrical connector includes a compliant attachment at a first end of the electrical connector, the ferrule-like attachment configured to be received by a printed circuit board; a male blade at a second end of the electrical connector extending from the first end along a longitudinal axis; the male blade configured to removably engage a female blade electrical connector, the male blade having a first side flap and a second side flap, the first side flap and second side flap each having an edge and each of the first side flap and second side flap folded over upon itself such that the edges of the first and second side flaps substantially oppose each other along the longitudinal axis; an intermediate region between the ferrule-like attachment and the male blade, wherein at least one of the first side flap and the second side flap includes a support tab that extends into the intermediate region.

14 Claims, 5 Drawing Sheets

MALE BLADE ELECTRICAL CONNECTOR

FIELD OF INVENTION

This invention relates to electrical terminal connectors and more particularly male blade electrical terminal connectors.

BACKGROUND

An electrical connector is an electro-mechanical device for joining electrical circuits as an interface using a mechanical assembly. Connectors consist of plugs (male-ended) and sockets (female-ended). The connection may be temporary, as for portable equipment, require a tool for assembly and removal, or serve as a permanent electrical joint between wires or devices. An adapter can be used to effectively bring together dissimilar connectors.

One type of electrical connector is a blade connector that can have a wire connection or a solderable connection, and uses a flat conductive blade that is inserted into a blade receptacle or socket. Usually both blade connector and blade receptacle have wires attached to them either through soldering of the wire to the blade or crimping of the blade to the wire. In some cases the blade is an integral manufactured part of a component (such as a printed circuit board, a switch or a speaker unit), and a blade receptacle is pushed onto the blade to form a connection.

SUMMARY

In a general aspect of the invention, an electrical connector comprising a compliant attachment at a first end of the electrical connector, the compliant attachment configured to be received by a printed circuit board; a male blade at a second end of the electrical connector extending from the first end along a longitudinal axis; the male blade configured to removably engage a female blade electrical connector, the male blade having a first side flap and a second side flap, the first side flap and second side flap each having an edge and each of the first side flap and second side flap folded over upon itself such that the edges of the first and second side flaps substantially oppose each other along the longitudinal axis; an intermediate region between the ferrule-like attachment and the male blade, wherein at least one of the first side flap and the second side flap includes a support tab that extends into the intermediate region.

Embodiments of the invention may include one or more of the following features. The thickness of the male blade is substantially twice the thickness of either of the first side flap and second side flaps or the ferrule-like attachment. The support tab not only extends into the intermediate region but extends through the intermediate region. The support tab is slanted or curved along two axes.

The compliant attachment is a ferule-like attachment and can include a pair of arcuate tabs for providing a frictional fit between the ferrule-like attachment and a hole formed within the printed circuit board. The ferrule-like attachment includes a pair of arcuate tabs for providing a frictional fit between the ferrule-like attachment and a hole formed within the printed circuit board. The male blade includes a hole. The second end of the electrical connector being beveled.

In another aspect of the invention, a method of making a male-blade electrical connector comprises providing a metal blank having a first thickness and a longitudinal axis, the metal blank having a rectangular region, a polygonal region and an intermediate region extending between the rectangular region and polygonal region, the rectangular region having first, second and third sides and having a support tab extending from the third side; bending the rectangular region such that the first side of the rectangular region faces the second side of the rectangular region proximal to the longitudinal axis such that the support tab extends over the third connection region; and forming the second polygonal region into a compliant attachment.

Embodiments of this aspect of the invention may include one or more of the following additional steps. The second polygonal region is slanted or curved along two axes. The second polygonal region is formed into a pair of arcuate tabs Among other advantages, the support tab makes the male blade connector stiffer and stronger relative to the ferrule-like attachment. Support tab provides an anchoring structure into the solder that ties the first region into the solderable elements of the attachment region and at a distance from the center structure transition, bridging the inherently weak intermediate region that is constructed from thinner sheet stock, thus providing secondary resistance to flexure from mechanical impact)—Because the ferrule-like attachment is generally attached to a printed circuit board, the support tab increases the stiffness of the male blade connector at the intermediate region. Thus, when the male blade connector is soldered within a via hole of the printed circuit board, the support tab minimizes the possibility of the male blade being snapped-off or otherwise separated from the ferrule-like attachment, for example, if inadvertently struck by an assembler.

Other features and advantages of the invention are apparent from the following description, and from the claims.

DETAILED DESCRIPTION

Figure 1:
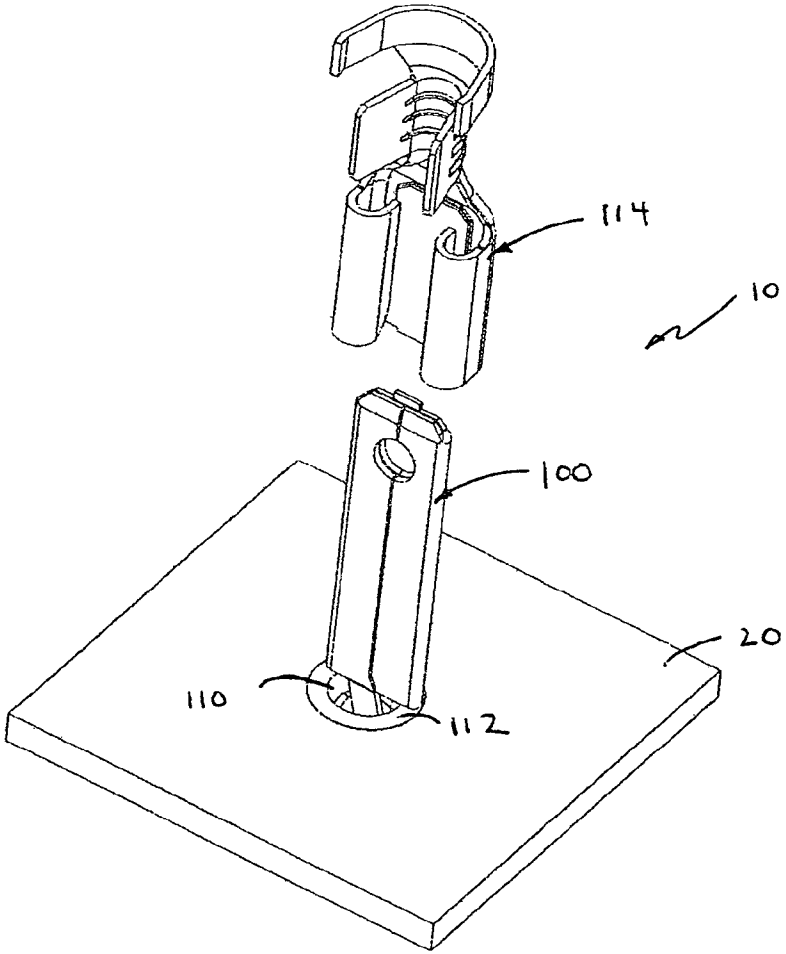
FIG. 1 is a perspective view of a representative male blade connector disposed within a portion of a printed circuit board assembly.

Referring to FIG. 1, a printed circuit board (PCB) assembly 10 is shown to include a printed circuit board 20 having holes or vias 110 (only one shown here) for receiving a male blade connector 100. The PCB 20 can be made of FR4 material and contain conductive traces, other vias, and other electrical components soldered to its surface. During assembly, male blade connector 100 is soldered into via 110 of the type having a solderable coating 112 on the inside to make it electrically conductive before assembly. Male blade connector 100 is formed of an electrically conductive, stamped metal (e.g., copper, nickel, gold, steel or an alloy, such as gold-plated brass). When soldered within via 110, male blade connector 100 is permanently connected to PCB 20. Male blade connector 100 is of the type that is configured to receive a female blade connector 114.

Figure 2:
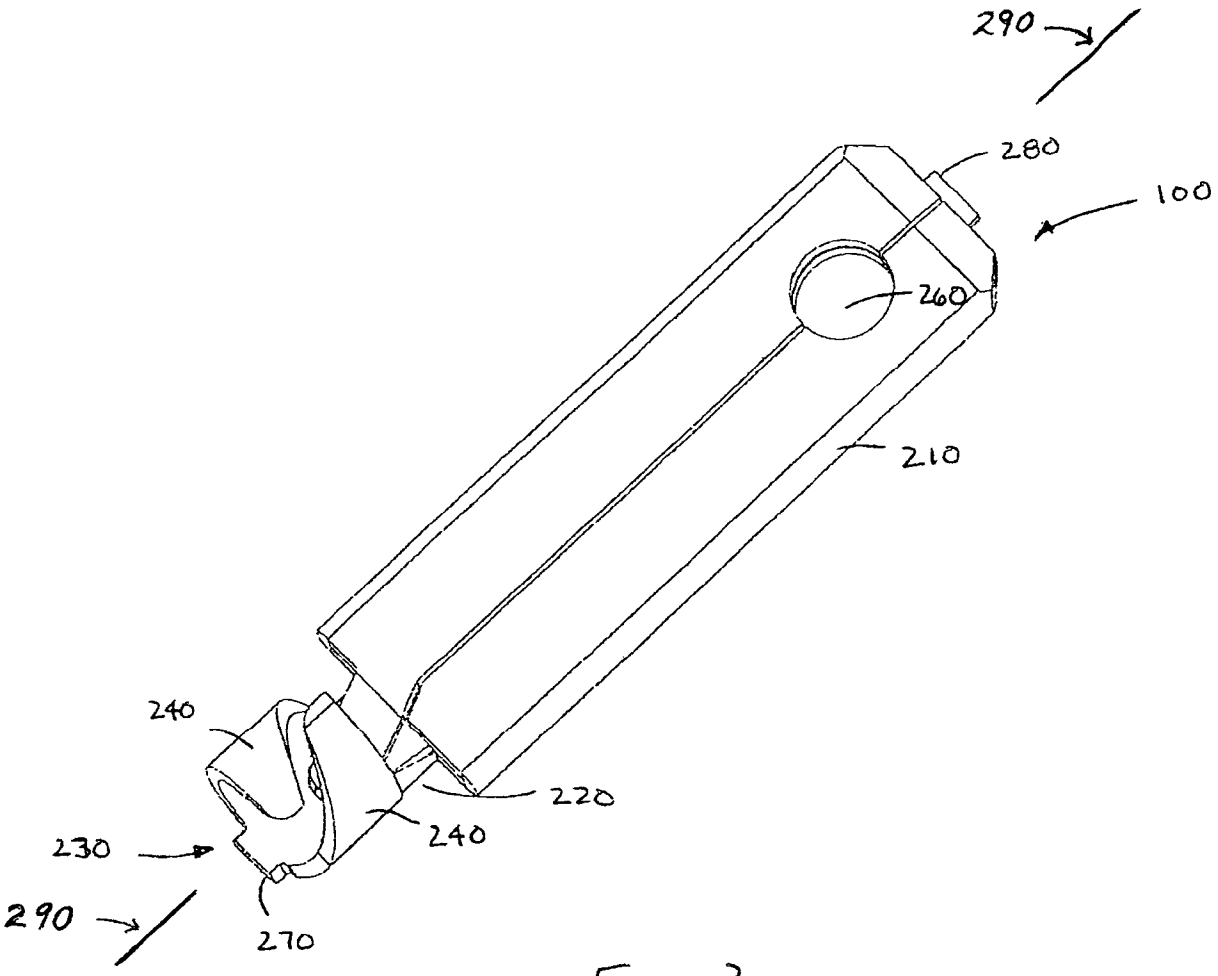
FIG. 2 is a perspective view of the male blade connector of FIG. 1.

Referring to FIG. 2, male blade connector 100 includes at a first end 270 a compliant attachment for insertion into PCB 20. In this embodiment, the compliant attachment is in the form of a ferrule-like attachment 230 includes arcuate tabs 240 that are formed into a cylindrical shape. Arcuate tabs 240 are sized and shaped such that the outer diameter of the ferrule-like attachment 230 is slightly larger than the diameter of via 110 to provide a cylindrical spring-like mechanism so that when inserted into via 110 a frictional fit temporarily holds the male blade connector 100 in PCB 20 until it is soldered in place.

Figure 3:
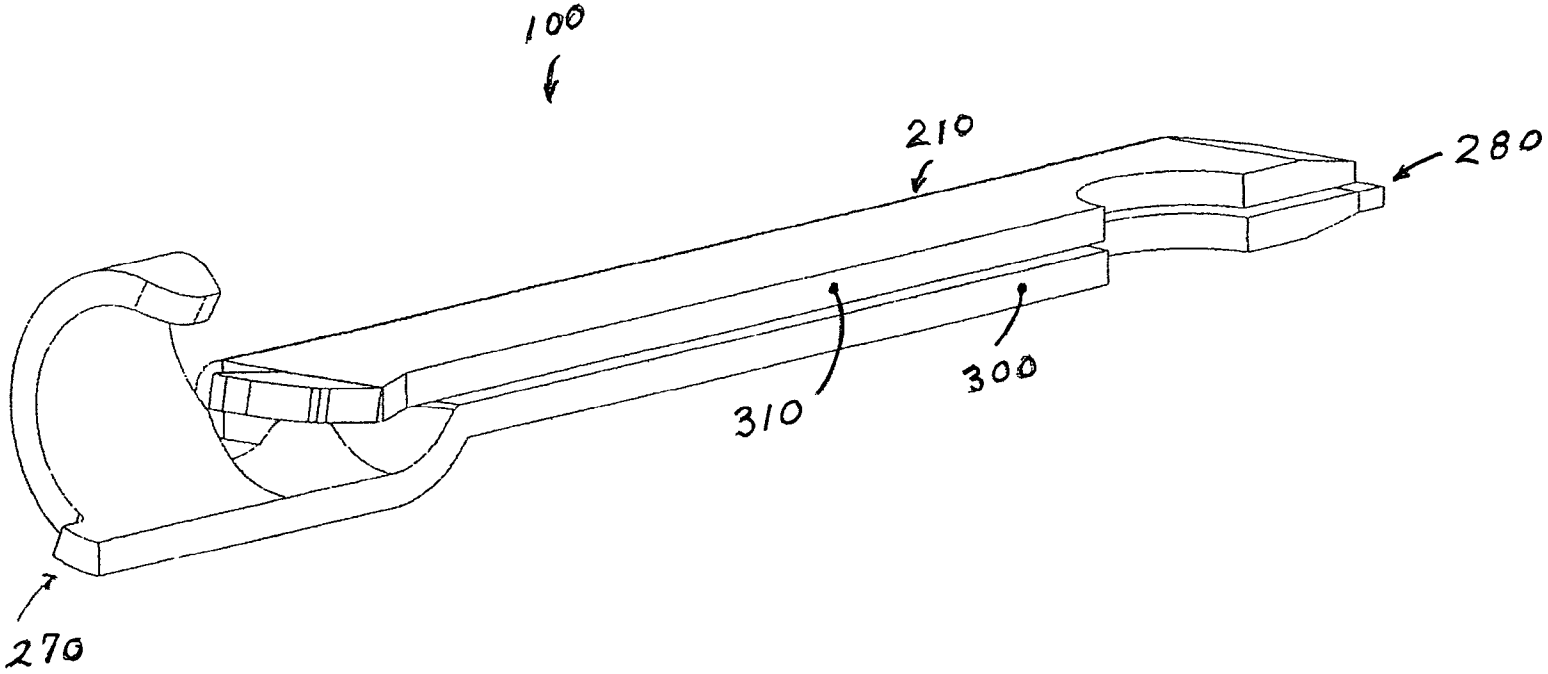
FIG. 3 is a cross-section of the male blade connector in FIG. 1.

At a second end 280 that is opposite first end 270, male blade connector 100 has a male blade 210 that is sized and configured to mechanically, electrically and removeably mate with a female blade electrical connector or receptacle connector (not shown). Male blade 210 extends along longitudinal axis 290 and has a hole 260 for receiving a detent mechanism on the mating female blade connector 114 (FIG. 1). As will be discussed below in conjunction with FIG. 4, male blade connector 100 has an intermediate region 220 between male blade 210 and ferrule-like attachment 230. The intermediate region 220 is polygonal in As shown most clearly in FIG. 3, male blade 210 is formed of a first layer 300 that, as will be discussed in greater detail below, folded over a second layer 310. In this embodiment, each of first layer 300 and second layer 310 is approximately 10 mils thick so that the combined thickness of male blade 210 is approximately 20 mils. In actuality, the first and second layers are about 0.008" thick because during the folding process, an air gap exists between the layers. As discussed above, the thickness of male blade 210 is commensurate with the size and configuration of female blade connector which receives male blade connector 100. Moreover, at second end 280, the male blade connector 100 is beveled to facilitate receiving the female blade connector. Because male blade 210 is twice as thick as the portion of male blade connector 100 used to form ferrule-like attachment, it has twice the structural rigidity of the ferrule-like attachment, which because requires spring-like characteristics, desirably has more flexibility.

Figure 4:
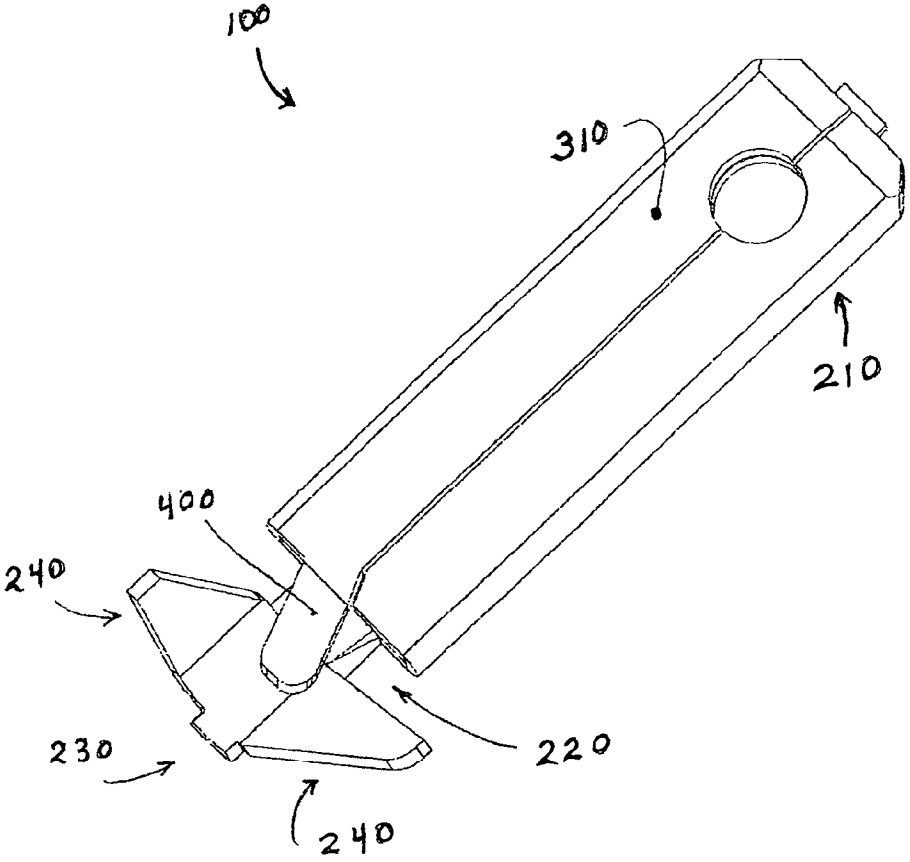
FIG. 4 is a perspective view of a partially fabricated male blade connector.

Referring to FIG. 4, male blade connector 100 is shown with arcuate tabs 240 in their flat, pre-rolled condition. At this stage of manufacture, one can better view intermediate region 220 of male blade connector 100. In particular, second layer 310 includes a support tab 400 that extends from the male blade 210 through the intermediate region 220 and, in this embodiment, extends into the space defined by arcuate tabs 240 of ferrule-like attachment 230. As discussed above, the thickness of the material forming ferrule-like attachment 230 is half the thickness of male blade 210. Moreover, when the male blade connector 100 is soldered within via hole 110 of PCB 20, male blade 210 is vulnerable to being snapped-off or otherwise separated from ferrule-like attachment 230 at intermediate region 220, for example, if inadvertently struck by an assembler.

Support tab 400 makes the installed male blade connector 100 stiffer and stronger. It functions as a tie strap, originating from a folded surface and terminating or anchoring in solder. Support tab 400 spans the intermediate region 220, thereby increasing the stiffness of male blade connector 100 at the intermediate region 220. Both the center and fold over are now anchored into the solder at some distance from one another, significantly strengthening each against impact damage.

In this embodiment, as shown most clearly in FIG. 4, support tab 400 is slanted or curved along two axes so as not to pull axially out of the solder.

Figure 5:
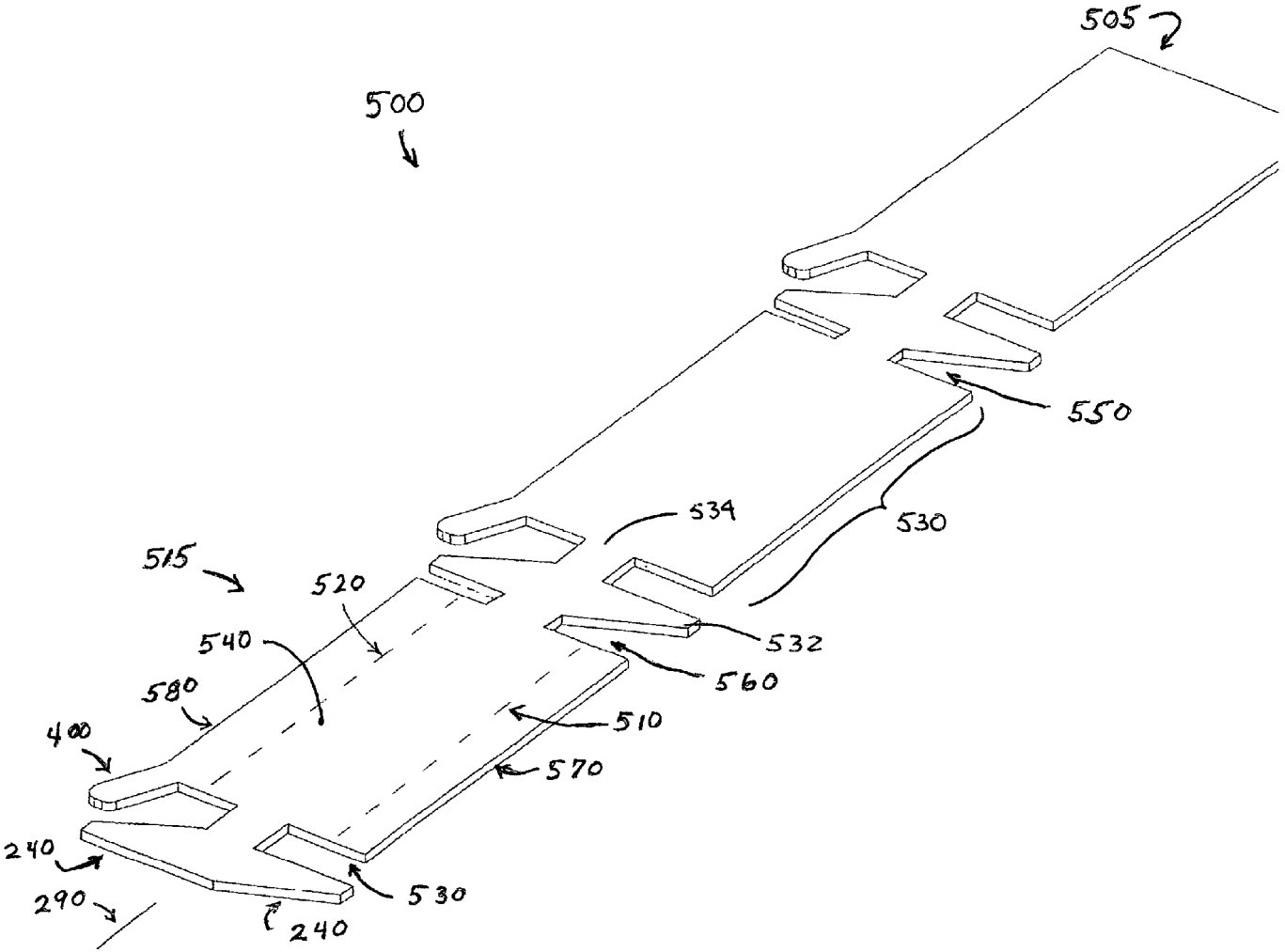
FIG. 5 is a perspective view of male blade connector blanks formed for use on electrical terminal reel.

Male blade connector 100 is formed using a machine press or stamping press process. Referring to FIG. 5, three male blade connector blanks 500 are shown connected together end to end. Male blade connector blanks 500 are formed from a single piece of conductive material 505 and will be singulated or otherwise separated from each other at points 550 and 560. Each male blade includes a rectangular region 530, a polygonal region 532 and an intermediate region 534. Fold lines 510 and 520 are shown on blank 515 as are first side flap 530 and second side flap 540.

In the manufacturing process, the first side flap 530 is folded over on itself on fold line 520, and the second side flap 540 is folded over on itself on fold line 510. First side flap 530 has edge 570 and second side flap 540 has edge 580. During the folding process, support tab 400 travels with edge 580 and becomes part of second layer 310. After folding, edges 570 and 580 substantially oppose each other along longitudinal axis 290. Polygonal region 532 are formed into arcuate tabs 240 and are part of first layer 300.

In one embodiment, the length and width of the male blade can be designed so as to conform to industry standards (e.g., UL310). For example, as discussed above, the thicknesses of the first layer 300 and second layer 310 can be approximately 0.010 inches. The length of the intermediate region plus the length of the attachment mechanism can be designed so as to accommodate the PCB thickness and not protrude below the PCB to an extent greater than other components on the board.

In another embodiment, as first layer 300 travels through the intermediate region 220, it may move out of the plane of the first layer 300 of male blade 210 and move the location of the ferrule-like attachment 230 relative to the male blade 210. In this embodiment support tab 400 may be apart from first layer 300 at the junction of the intermediate region 220 and the ferrule-like attachment 230.

In another embodiment, the cylindrical shape of arcuate tabs 240 and 250 may be smaller than the hole 110 of PCB 20.

In another embodiment, arcuate tabs 240 and 250 may be configured to be soldered permanently onto a cylindrical conductor (not shown).

In another embodiment, the attachment mechanism 230 may not be cylindrical in shape but may be configured to solder onto an electrical conductor.

In another embodiment, a female electrical connector may be substituted for male blade 210 such that the female electrical connector is configured to receive a male blade It is to be understood that the foregoing description is intended to illustrate and not to limit the scope of the invention, which is defined by the scope of the appended claims. Other embodiments are within the scope of the following claims.

What is claimed is:

1. An electrical connector comprising a compliant attachment at a first end of the electrical connector, the compliant attachment in the form of a ferrule-like attachment and configured to be received within a hole in a printed circuit board, the ferrule-like attachment having a proximal end extending to a distal end and defining a cylindrical region therebetween;

a male blade at a second end of the electrical connector extending from the first end along a longitudinal axis;

the male blade configured to removably engage a female blade electrical connector, the male blade having a first side flap and a second side flap, the first side flap and second side flap each having an edge, the first side flap folded over upon itself, and the second side flap folded over upon itself, such that the edges of the first and second side flaps substantially oppose each other along the longitudinal axis;

an intermediate region between the compliant attachment and the male blade wherein at least one of the first side flap and the second side flap includes a support tab that extends in a direction along the longitudinal axis through the intermediate region and into the cylindrical region of the ferrule-like attachment.

2. The electrical connector of claim 1, wherein the thickness of the male blade is substantially twice the thickness of either of the first side flap and second side flap.

3. The electrical connector of claim 1 wherein the compliant attachment mechanism is configured to be attached to a via hole formed within a printed circuit board.

4. The electrical connector of claim 1 wherein the compliant attachment includes a pair of arcuate tabs for providing a frictional fit between the compliant attachment and a hole formed within a printed circuit board.

5. The electrical connector of claim 1 wherein the support tab is slanted or curved along two axes.

6. The electrical connector of claim 1 wherein the compliant attachment mechanism is configured to be attached to another electrical connector.

7. The electrical connector of claim 1, wherein the male blade includes a hole.

8. The electrical connector of claim 1, wherein the second end of the electrical connector is beveled.

9. A method of making a male-blade electrical connector comprising:

providing a metal blank having a first thickness and a longitudinal axis, the metal blank having a rectangular region, a polygonal region and an intermediate region extending between the rectangular region and polygonal region, the rectangular region having first, and second sides and having a support tab extending from the second side;

bending the rectangular region such that the first side folds over upon itself, and the second side folds over upon itself, such that the support tab extends over the second side and along the longitudinal axis; and forming the polygonal region into a ferrule-like attachment having a proximal end extending to a distal end and defining a cylindrical region therebetween, wherein the support tab extends into the cylindrical region of the ferrule-like attachment.

10. The method of claim 9 wherein the polygonal region is slanted or curved along two axes.

11. The method of claim 10 wherein forming the polygonal region into the ferrule-like attachment further comprises forming the second polygonal region into a pair of arcuate tabs.

12. The electrical connector of claim 1 wherein the intermediate region is defined by a junction between the male blade and the ferrule-like attachment.

13. The electrical connector of claim 1 wherein the male blade has a first width and the intermediate region has a second width, the second width being less than the first width.

14. The method of claim 9 wherein the rectangular region has a first width and the intermediate region has a second width, the second width being less than the first width.

* * * * *